US006254342B1

(12) United States Patent
Fujinaka et al.

(10) Patent No.: US 6,254,342 B1
(45) Date of Patent: Jul. 3, 2001

(54) AIR SUPPLYING DEVICE

(75) Inventors: Hiroyasu Fujinaka, Kadoma; Shigeru Otsuka, Yonago, both of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/380,687

(22) PCT Filed: Dec. 28, 1998

(86) PCT No.: PCT/JP98/06021

§ 371 Date: Sep. 2, 1999

§ 102(e) Date: Sep. 2, 1999

(87) PCT Pub. No.: WO99/35404

PCT Pub. Date: Jul. 15, 1999

(30) Foreign Application Priority Data

Jan. 8, 1998 (JP) ..... 10-001950

(51) Int. Cl.[7] ..... F04D 29/66

(52) U.S. Cl. ..... 415/208.5; 415/119; 415/211.1; 416/237; 416/238; 416/DIG. 5

(58) Field of Search ..... 415/186, 187, 415/208.3, 208.5, 211.1, 214.1, 119, 220, 223, 209.1; 416/235, 237, 228, 242, 243, 238, DIG. 5

(56) References Cited

U.S. PATENT DOCUMENTS

| | | | | |
|---|---|---|---|---|
| 2,027,745 | * | 1/1936 | Montgomery | 415/211.1 |
| 4,568,242 | * | 2/1986 | Susa et al. | 416/237 |
| 4,569,631 | * | 2/1986 | Gray, III | 416/238 |
| 4,684,324 | * | 8/1987 | Perosino | 416/238 |
| 4,830,574 | * | 5/1989 | Wainauski et al. | 416/242 |
| 4,840,541 | * | 6/1989 | Sakane et al. | 415/119 |
| 4,869,644 | * | 9/1989 | Takigawa | 416/237 |
| 4,930,990 | * | 6/1990 | Brackett | 416/238 |
| 4,941,803 | * | 7/1990 | Wainauski et al. | 416/242 |
| 5,096,373 | | 3/1992 | Struve et al. . | |
| 5,273,400 | * | 12/1993 | Amr | 416/242 |
| 5,320,493 | * | 6/1994 | Shih et al. | 416/238 |
| 5,391,056 | | 2/1995 | Wang . | |
| 5,616,004 | * | 4/1997 | Alizadeh | 416/238 |
| 5,707,205 | * | 1/1998 | Otsuka | 415/208.5 |
| 5,957,661 | * | 9/1999 | Hunt et al. | 416/237 |
| 6,059,532 | * | 5/2000 | Chen et al. | 416/237 |

FOREIGN PATENT DOCUMENTS

| | | | | |
|---|---|---|---|---|
| 58-77200 | * | 5/1983 | (JP) | 415/223 |
| 4-41995 | | 2/1992 | (JP) . | |
| 4-30299 | | 3/1992 | (JP) . | |
| 6-229398 | * | 8/1994 | (JP) | 415/119 |
| 6-249195 | | 9/1994 | (JP) . | |

* cited by examiner

*Primary Examiner*—Christopher Verdier
(74) *Attorney, Agent, or Firm*—Parkhurst & Wendel, L.L.P.

(57) ABSTRACT

Improvement is made to the shape of blades of a fan assembly for sucking air into an annular wall through slits in the wall, in order to increase the aerodynamic performance and energy efficiency. In the fan assembly for sucking air in through slits provided in an annular wall (2), the blade tips of an axial fan (21) are bent in the rotating direction to smoothly take in air flowing in through the slits. The axial fan is formed so that the blades except the tips thereof are in a shape of a radial or a rearward tilting blade. The angle formed by the blade forward tilting angle near the blade tip of the axial fan and the slit angle is between −5 and 15°, and the blade tip is bent in the wind blowout direction. This configuration improves the P-Q characteristic, reduces noise and improves energy efficiency.

9 Claims, 18 Drawing Sheets

FIG.9
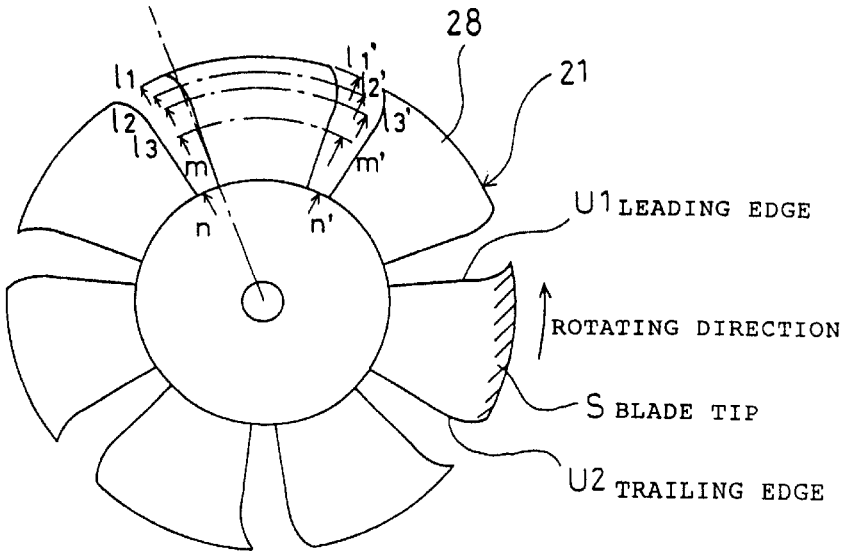
FIG. 10 (a)
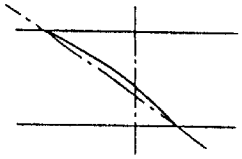
CROSS SECTIONAL VIEW OF BLADE ALONG l1-l1'
FIG. 10(b)
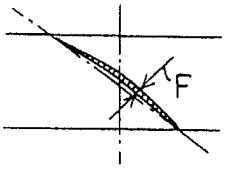
CROSS SECTIONAL VIEW OF BLADE ALONG l2-l2'
FIG. 10(c)
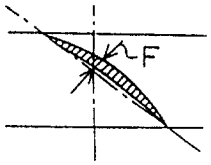
CROSS SECTIONAL VIEW OF BLADE ALONG l3-l3'
FIG. 10(d)
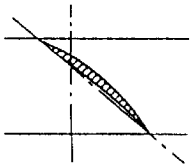
CROSS SECTIONAL VIEW OF BLADE ALONG m-m'
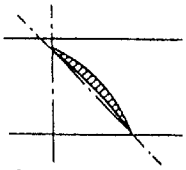
CROSS SECTIONAL VIEW OF BLADE ALONG n-n'
FIG. 10(e)

CROSS SECTIONAL VIEW ALONG a-a'

CROSS SECTIONAL VIEW ALONG b-b'

CROSS SECTIONAL VIEW ALONG c-c'

CROSS SECTIONAL VIEW ALONG a-a'

CROSS SECTIONAL VIEW ALONG b-b'

CROSS SECTIONAL VIEW ALONG c-c'

CROSS SECTIONAL VIEW ALONG a-a'

CROSS SECTIONAL VIEW ALONG b-b'

CROSS SECTIONAL VIEW ALONG c-c'

PRIOR ART

CROSS SECTIONAL VIEW OF BLADE ALONG l-l'

CROSS SECTIONAL VIEW OF BLADE ALONG m-m'

CROSS SECTIONAL VIEW OF BLADE ALONG n-n'

PRIOR ART

FIG.32 PRIOR ART
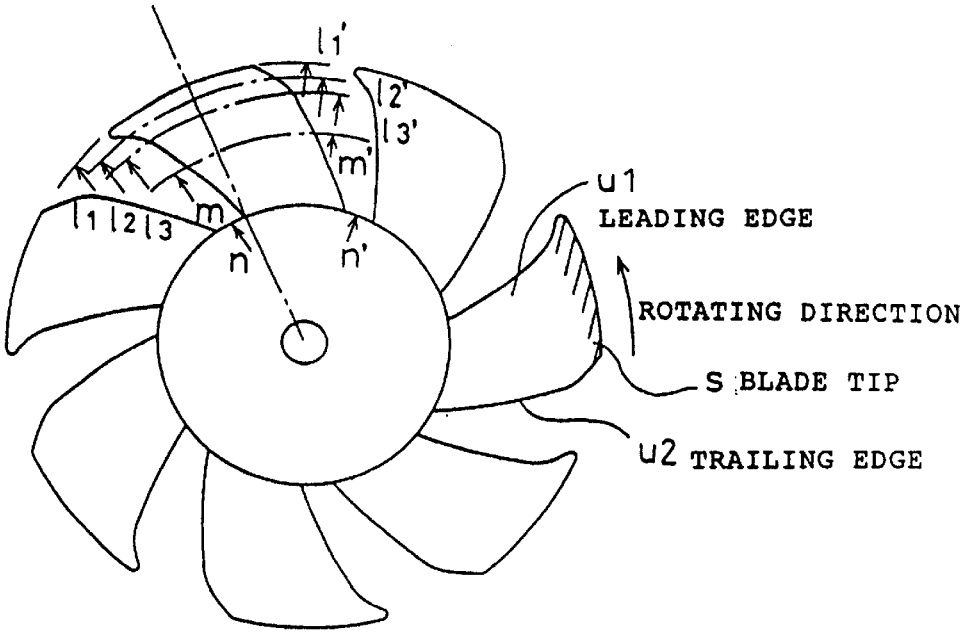
FIG. 33(a) PRIOR ART
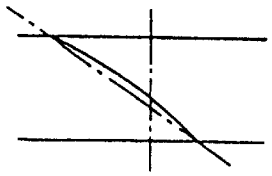
CROSS SECTIONAL VIEW OF BLADE ALONG l1-l1'
FIG. 33(b) PRIOR ART
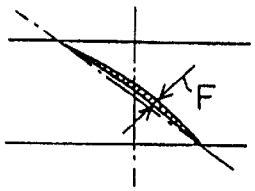
CROSS SECTIONAL VIEW OF BLADE ALONG l2-l2'
FIG. 33(c) PRIOR ART
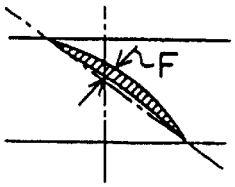
CROSS SECTIONAL VIEW OF BLADE ALONG l3-l3'
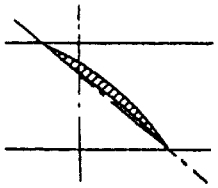
CROSS SECTIONAL VIEW OF BLADE ALONG m-m'
FIG. 33(d) PRIOR ART
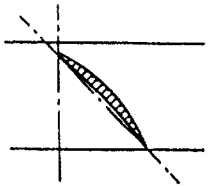
CROSS SECTIONAL VIEW OF BLADE ALONG n-n'
FIG. 33(e) PRIOR ART

AIR SUPPLYING DEVICE

TECHNICAL FIELD

The present invention relates to a fan assembly used for electronic equipment and the like.

BACKGROUND ART

Due to the spread of small electronic equipment many attempts have been made in recent years to achieve high-density packaging of electric circuits. Thus, due to the increase in the exothermic density of electronic equipment, axial or mixed-flow fans are used to cool the equipment.

In a conventional fan assembly, an axial fan 1 is placed in such a manner as to provide an appropriate space between blade tips of the fan and the inner circumferential surface of an annular wall 2, as shown in FIG. 20, so that in a blowing state in which a motor section 3 is powered on, the axial fan 1 rotates around a shaft 4 to cause an air flow 5 from a suction side to a discharge side. In this blowing state, however, the speed of the air flow increases on the suction side of the tips of fan blades 8, and the energy of the air flow is converted into a pressure energy. Consequently, inter-blade secondary flows occur at the trailing edges of the blades to create low-energy areas at these edges. In this part of the fan assembly, a large loss is likely to occur to release the flow, and in such a case, the air flow leaves a plate surface and vortexes occur in this area. As a result, turbulence noise may increase to degrade the noise level and the static pressure-air quantity characteristic (hereinafter referred to as the "P-Q characteristic"). This phenomenon is frequently observed particularly if the discharge side is subjected to flow resistance (system impedance) to cause more leaking vortexes at the blade tips, thereby stalling the axial fan.

In order to improve the characteristics of such an axial fan, the shape of the annular wall provided at the outer circumference of the axial fan has been improved in the fan assemblies described in Japanese Patent Application No. 8-174042, Japanese Patent Application No. 9-151450 and Japanese Patent Application No. 9-260738 all assigned to the applicant. These fan assemblies are shown in FIGS. 21 to 23 wherein annular plates 7*a* to 7*e* are provided in a casing body 9 as the annular wall 2 encompassing the axial fan 1. The annular plates 7*a* to 7*e* are laminated via spacers 13, and a slit 6 is formed between each pair of adjacent annular plates 7*a* to 7*e*. In a blowing state, this configuration allows air to be sucked into the annular wall 2 through the slits 6 provided between the annular plates 7*a* to 7*e*, in order to restrain occurrence of leaking vortexes at the blade tips as well as rotating stall, thereby improving the P-Q characteristic and reducing noise. In addition, National Publication of International Patent Application No. 6-508319 and U.S. Pat. No. 5,292,088 describe such fan assemblies that comprise a plurality of ring bodies arranged at the outer circumference of the axial fan at intervals so that air vortexes flowing through the gaps between the ring bodies increase the flow rate of the fluid. Alternatively, U.S. Pat. No. 5,407,324 describes a fan assembly wherein the inner circumferential portions of annular plates encompassing the outer circumference of the axial fan are inclined along the direction of the wind and wherein these annular plates are accumulated so as to form a plurality of stages in order to enable air to flow between the inner and outer circumferences of the annular wall.

Although these inventions all improve the characteristics of the axial fan by sucking air from the outer circumference of the axial fan, they describe only the configuration of the ring bodies (annular plates) provided at the outer circumferential portion of the axial fan but do not particularly describe the shape of the axial fan. Thus, to make most of the characteristics of the axial fan, the shape of the fan must be adjusted to the annular wall. The shape of the axial fan has been generally improved by cutting the blades of the axial fan in their cylindrical surfaces concentric with a rotating shaft of the axial fan, developing the cylindrical surfaces to be replaced by a planar infinite linear blade series, applying to this blade series the linear blade profile series theory established for airplanes and the like in order to predict performance or to determine a three-dimensional shape suitable for operating conditions.

FIGS. 24 to 29 show the shapes of conventional axial fans by way of examples. As shown in FIGS. 26 and 27, a cross section of a conventional axial fan 1 obtained by cutting it in a way of forming a cylinder concentric with the rotating shaft is in such a form that wing-shaped blades 8 are joined together in the radial direction. This is because the air flows in the radial direction of the axial fan 1 are ignored in designing the conventional axial fan. According to this design, calculated and actual values have not significantly deviated from each other if the axial fan has an annular wall that prevents air from flowing in from the outer circumference and if it is operated with a relatively low air flow resistance. In addition, in order to improve the characteristics of the axial fan when the air flow resistance is slightly high, an advancing blade is used in which the chord center line of the blade is inclined at a specified angle in the rotating direction, as shown in FIGS. 28 and 29. In FIG. 24, a thin line h is an iso-thickness line denoting the thickness of the blade, an alternate long and short dash line i is a chord center line obtained if the blade is cut in a concentric cylindrical surface, and a broken line k denotes the position of the maximum thickness obtained if the blade is cut in a concentric cylindrical surface. When this conventional axial fan is used in combination with the casing 9 with the slits provided in the annular wall therein, the air flows on the blades of the axial fan flow in the directions shown by the arrows in FIG. 24. FIG. 25 shows the blade, which has been cut in the cross section shown by alternate long and two short line a—a' that extends along this air flow. In FIG. 25, the neighborhood of the blade tip s is formed to be thicker to some degree, so air flows flowing onto this part collide against the surface of the blade tip and the air layer is released near both edges t1 of the tip. In addition, the distribution of the blade thickness, on which the blade performance significantly depends, substantially deviates from an ideal blade shape arrangement, so the blade shape cannot be expected to contribute to effecting a lift. The air layer is likely to be released at the trailing edge t2, thereby degrading the characteristics of the axial fan.

An invention that does not suck air from the outer circumference of the annular wall but that attempts to improve the characteristics of the axial fan by improving the shape of the blade tip is the impeller described in Japanese Patent Laid-Open No. 6-307396 wherein the aerodynamic force is improved while noise is reduced by configuring the cross section of the outer circumferential blade tip so as to include a single-side curved shape located at the leading edge and having projecting curves only on the pressure surface side; and a circular shape portion contiguous to the single-side curved shape. In addition, Japanese Patent Laid-Open No. 8-121391 describes an electric fan that reduces aerodynamic noise by folding the outer circumference of the blade into a curve. Alternatively, Japanese Patent Application Laid-Open No. 8-284884 describes a fluid machine wherein the outside of the tip of a moving blade is removed over a specified height from its tip end to form a thinner portion of a specified thickness at the inside of the tip in order to reduce the leakage of a fluid through the tip clearance, thereby improving the efficiency of an axial fan. It is premised that these conventional techniques for the shape of the axial fan, however, require to provide an annular wall preventing air from flowing in from its outer circumference, so sufficient characteristics cannot be obtained by applying such blade shapes to a configuration for sucking air from the outer circumference of the annular wall, as described above.

An invention that requires air inflow through slits provided in the outer circumference of the axial fan in order to optimize the shape of the axial fan is the fan assembly in Japanese Patent Application No. 9-260738 assigned to the applicant and shown in FIGS. 29 to 33. In FIG. 30, a thin line h is an iso-thickness line denoting the thickness of a blade, an alternate long and short dash line i is a chord center line obtained if the blade is cut in a concentric cylindrical surface, and a broken line k denotes the position of the maximum thickness in a cross section obtained by cutting the blade at a concentric cylindrical surface. FIG. 31 shows the blade, which has been cut in the cross section shown by an alternate long and two short line a–a' that extends along the air flow. As shown in FIG. 29, among sweepforward angles θ1 to θ3, the sweepforward angle θ3 at the blade tip is formed to be larger than the two others. In other words, the blade is formed by folding the blade tips in the rotating direction. This configuration enables air flows flowing in through the slits to be smoothly taken in to improve the P-Q characteristic of the fan assembly. Furthermore, the blade is shaped in such a way that as the blade tip approaches, the position of the maximum thickness in a cross section obtained by cutting the blade in a concentric cylindrical surface gradually moves backward toward the trailing edge of the blade. Specifically, the cross sections of the blade along lines $\mathbf{1}_1$–$\mathbf{1}_1$', $\mathbf{1}_2$–$\mathbf{1}_2$', $\mathbf{1}_3$–$\mathbf{1}_3$', m–m', and n–n' shown in FIG. 32 are shaped as shown in FIGS. 33(*a*) to (*e*), respectively. Reference numeral F denotes the position of the maximum thickness. As shown in FIG. 31, this shape maximizes the blade shape effect even on air flows flowing in from the outer circumference of the annular wall and allows air flowing in through the slits to flow smoothly at the blade tip. Furthermore, according to this shape, the blade shape effect also serves to cause a lift acting on air flows flowing in from the blade tip or the air layer is restrained from being released at the trailing edge to enable the air flows flowing in through the slits to be effectively converted into an air capacity, thereby further improving the P-Q characteristic of the fan assembly.

An object of the present invention is to further improve the blade shape of the fan assembly that sucks air into the annular wall through the slits provided in these walls as in Japanese Patent Application No. 9-260738, thereby improving the aerodynamic performance or energy efficiency.

DISCLOSURE OF THE INVENTION

In a fan assembly according to the present invention, to attain the above object, an annular wall is formed with a space left from the blade tips of a fan, and a plurality of slits communicating the inner and outer circumferential portions of the annular wall with each other are formed in a portion of the annular wall opposite to the blade tips of the fan. The fan is formed in a radial blade shape with a zero sweepforward angle, wherein the blade tips are bent in the rotating direction while the portions of the blades other than the tips thereof are not inclined in the rotating direction.

In addition, in the fan assembly according to this invention, an annular wall is formed with a space left from the blade tips of a fan, and a plurality of slits communicating the inner and outer circumferential portions of the annular wall with each other are formed in a portion of the annular wall opposite to the blade tips of the fan. The fan is formed so that a blade has a rearward projecting angle in which the blade tips are bent in the rotating direction while other portions thereof than the blade tips are inclined in the direction opposite to the rotating direction.

In addition, in the fan assembly according to this invention, an annular wall is formed with a space left from the blade tips of a fan, and a plurality of slits communicating the inner and outer circumferential portions of the annular wall with each other are formed in a portion of the annular wall opposite to the blade tips of the fan. The fan is configured so that the blade tips are bent in the rotating direction, the forward tilting angle of the blade tip relative to the radial direction is −5 to 15°, and the blade tip and the vicinity thereof are bent in the wind blowout direction.

In addition, one of these fan assemblies is provided in a electronic equipment as a fanning means.

The above configuration allows air flowing in through the slits to be smoothly taken in, thereby improving the P-Q characteristic of the fan assembly and reducing noise from the fan assembly. In addition, if the above fan assembly is provided in a electronic equipment such as a personal computer, noise from the electronic equipment can be reduced and the cooling and energy efficiency can be improved.

BRIEF DESCRIPTION OF THE DRAWINGS

FIG. 9 is a front view of the axial fan according to the embodiment;

FIGS. 10(*a*) to (*e*) are sectional views showing the thickness of each section of a blade of the axial fan in FIG. 9;

FIG. 32 is a front view of the axial fan according to the prior art; and

FIGS. 33(*a*) to (*e*) are sectional views showing the thickness of each portion of a blade of the axial fan according to the prior art.

EMBODIMENTS OF THE INVENTION

Figure 1:
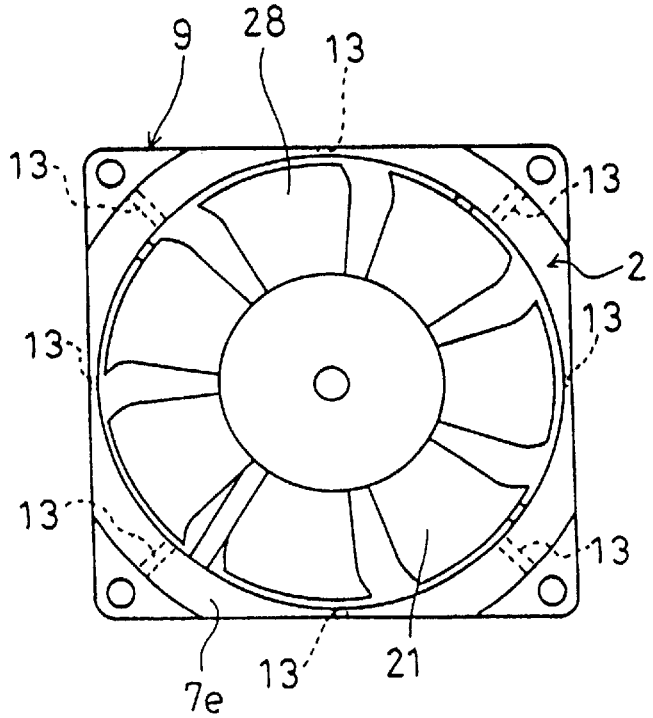
FIG. 1 is a front view showing an axial fan assembly according to an embodiment of this invention.
Figure 2:
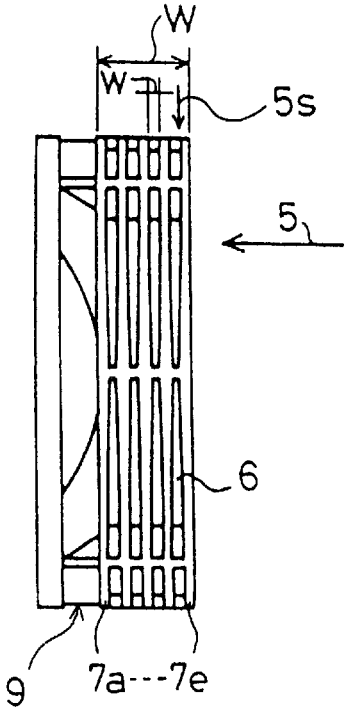
FIG. 2 is a side view showing the axial fan assembly.
Figure 3:
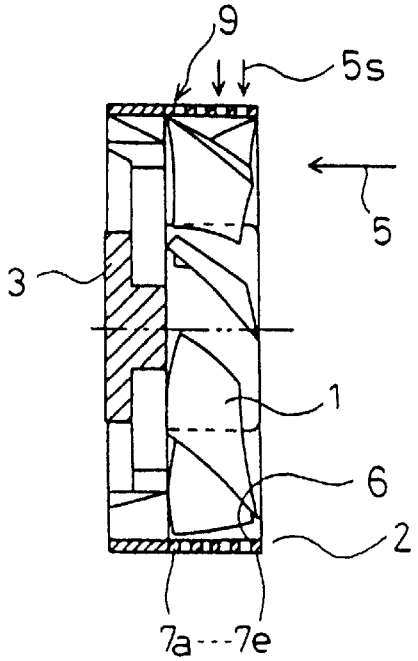
FIG. 3 is a sectional view showing the axial fan assembly.

An embodiment of this invention will be described below with reference to the drawings. FIGS. 1 to 3 show a fan assembly according to this embodiment. Members similar to those shown above have the same reference numerals, and their description is omitted. As shown in FIG. 2, the width W of laminated annular plates 7*a* to 7*e* is set at the same value as the axial width of an axial fan 21 or almost the same value as the axial width of an axial fan 1. In addition, the width w of the gap between slits 6 is continuously varied so as to almost equalize the inflow resistance of each portion. When the axial fan 1 is rotationally driven, a negative pressure is generated on the suction side of the tips of blades 28, and due to the difference between this pressure and the atmospheric pressure outside the slits 6, air flows 5*s* flow toward the interior through the slits 6. When the width w of the gap between the slits 6 is set at an appropriate value, the air flows 5*s* flowing through the slits 6 become layer flows to restrain leaking vortexes generated at the blade tips and flowing from a positive pressure side to a suction side. This configuration prevents the air flows from leaving the suction surface to improve the P-Q characteristic while reducing noise.

Figure 4:
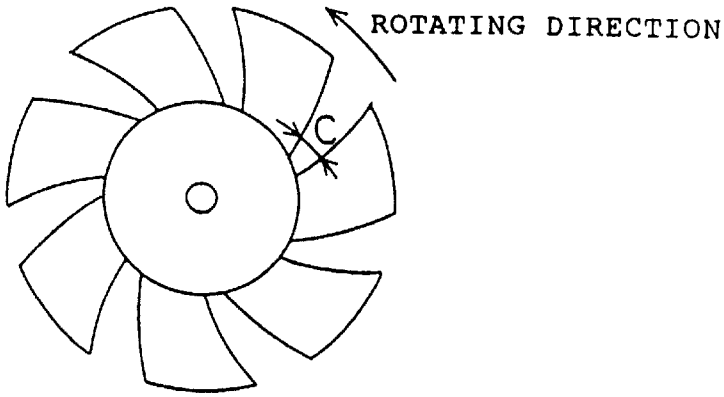
FIG. 4 is a front view of an axial fan of a general forward-tilting blade type.
Figure 5:
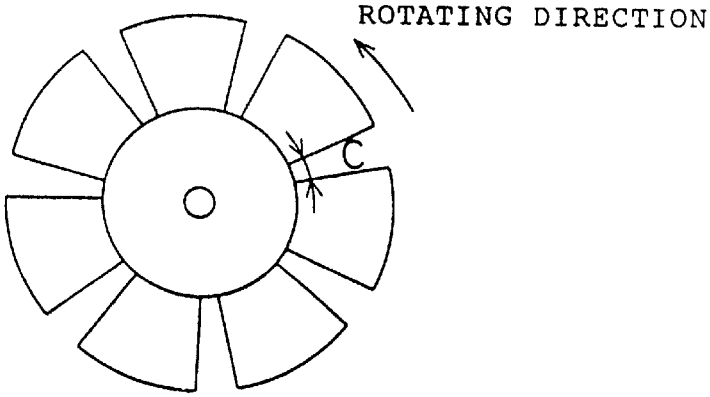
FIG. 5 is a front view of an axial fan of a general radial blade type.
Figure 6:
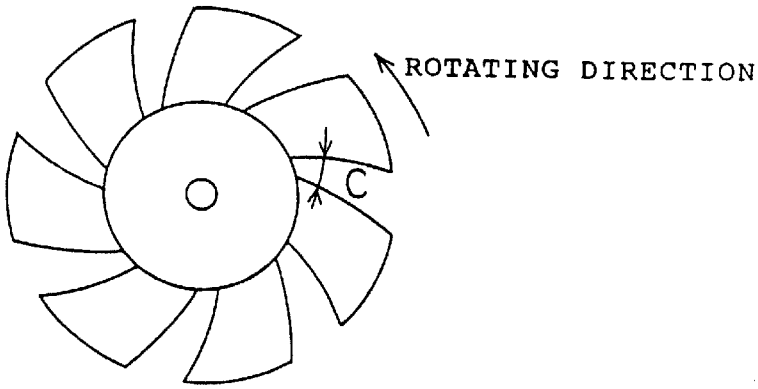
FIG. 6 is a front view of an axial fan of a general rearward-tilting blade type.

Although the axial fan is generally molded by means of resin injection, injection molding limits the shape of the axial fan due to the configuration of molds and axial fans of an advancing blade type formed by means of injection molding disadvantageously have a small blade axial projected area. FIG. 4 shows an axial fan of a blade type having a forward tilting angle in which the chord-wise central position of the blade is inclined in the rotating direction (its sweepforward angle has a positive value), FIG. 5 shows an axial fan of a radial blade type in which the chord-wise central position of the blade is on the radius (its sweepforward angle is zero), and FIG. 6 shows an axial fan of a blade type having a rearward projecting angle in which the chord-wise central position of the blade is inclined in the direction opposite to the rotating direction (its sweepforward angle has a negative value). In all cases, the outer diameter of the blade is the same. The size c of the gap between the adjacent blades is restricted by the structure of the mold and must be constant for any shape. As shown in FIGS. 4 to 6, if the sizes c of the gaps between the adjacent blades are set equal, the axial fans of such blade types as having a forward tilting angle and a rearward projecting angle have a smaller blade axial projected area than the axial fan of a radial blade type and fail to provide the same performance as the radial blade type unless the workload of the blade per area is increased. Increasing the workload of the blade requires the blade angle (the torsion angle of the blade around the radial shaft) to be increased, but increasing the blade angle may increase the air resistance of the blade and thus the axial-fan driving force and may release the boundary layer on the blade suction side earlier, frequently resulting in stalling.

Thus, this embodiment optimizes the shape of the blade tip based on the axial fan of the radial blade type having the smallest workload of the blade per area, that is, the smallest blade load. FIGS. 7 to 10 show an axial fan 21 according to this embodiment. In FIGS. 7 to 10, the shape of the tip of a blade 28 is almost the same as that of the axial fan in Japanese Patent Application No. 9-260738 shown in FIGS. 29 to 33, but this blade differs from that in Japanese Patent Application No. 9-260738 in that except for the tip, the blade is shaped like a radial blade having a zero sweepforward angle to provide a larger blade axial projected area despite the same size of the axial fan.

Figure 7:
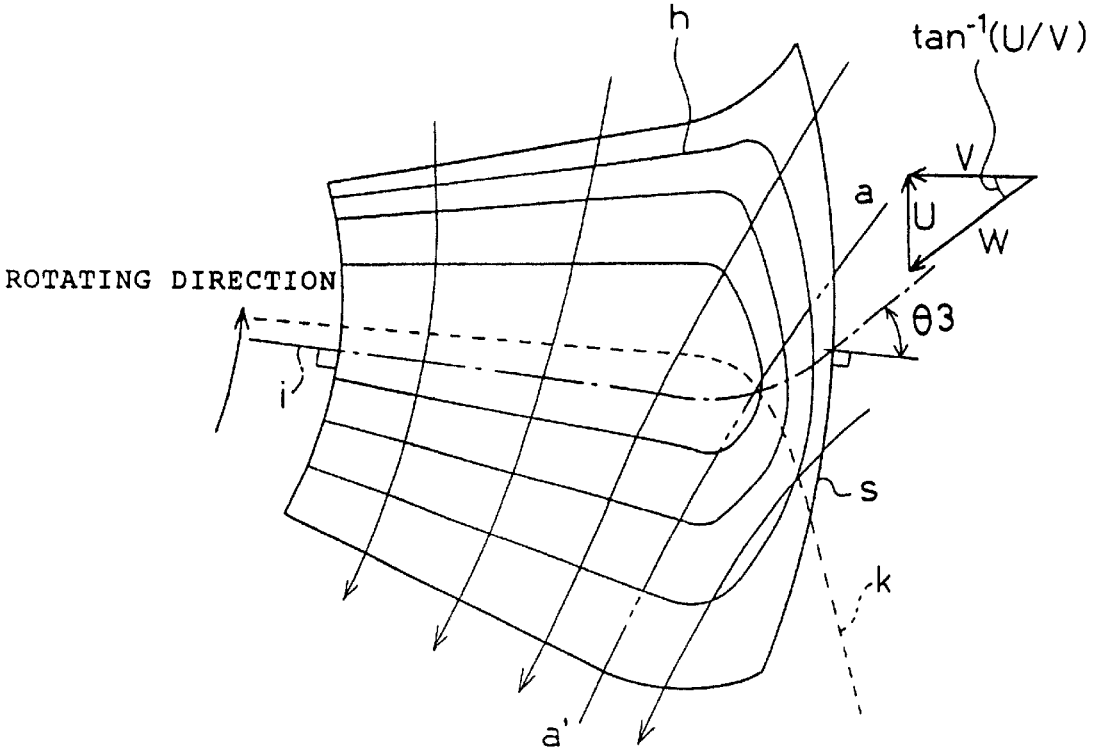
FIG. 7 is a blade iso-thickness diagram of an axial fan according to an embodiment of this invention.

The shape of the axial fan 21 will be described in detail and clarified below. In FIG. 7, the blade tip s of the axial fan 21 is formed by folding it in the rotating direction. Air flows flowing in through the slits 6 form flows v advancing in an almost radial direction, and the blade tip is rotated at a peripheral speed u. Thus, relative air flows flow in from a direction w as seen from the blade 28. Folding the blade tip in the rotating direction smoothes these air flows. To equalize this wind flow with the forward tilting angle of the blade tip of the axial fan, the sweepforward angle θ3 at the blade tip is preferably set so as to meet the following condition.

$$\theta=\tan^{-1}(u/v)$$

Figure 8:
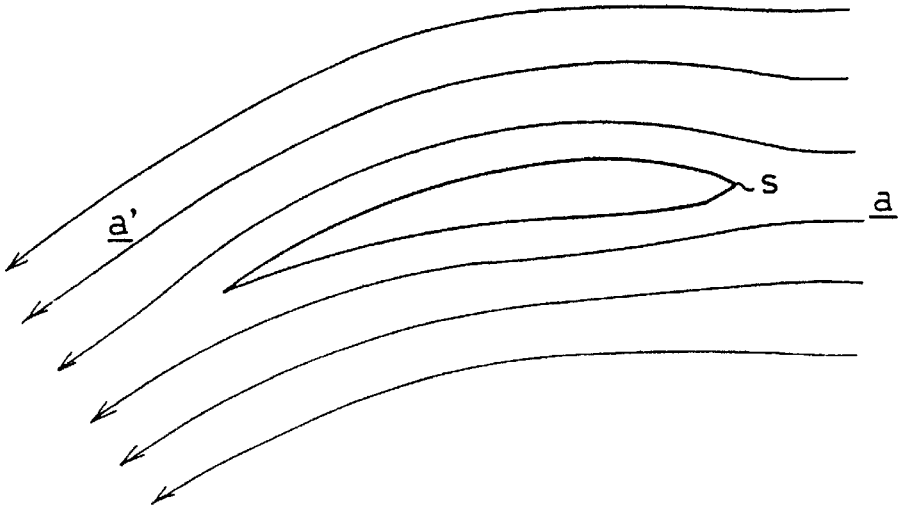
FIG. 8 is a sectional view of the axial fan according to the embodiment.

This setting allows the wind to flow in most smoothly and provides advantageous conditions in terms of both the P-Q characteristic and noise. In addition, in FIG. 7, thin line h is an iso-thickness line denoting the thickness of the blade 28, alternate long and short dash line i is a chord center line in a cross section obtained if the blade 28 is cut in a concentric cylindrical surface, and broken line k denotes the position of the maximum thickness in a cross section obtained if the blade 28 is cut in a concentric cylindrical surface. FIG. 8 shows the blade 28, which has been cut in the cross section shown by alternate long and two short line a–a' that extends along the air flow. Furthermore, the cross sections of the blade 28 along the lines $\mathbf{1}_1$–$\mathbf{1}_1$', $\mathbf{1}_2$–$\mathbf{1}_2$', $\mathbf{1}_3$–$\mathbf{1}_3$', m–m', and n–n' shown in FIG. 9 are shaped as shown in FIGS. 10(*a*) to (*e*), respectively. Reference numeral F denotes the position of the maximum thickness. As shown in FIG. 10, the blade is shaped in such a way that as the blade tip approaches, the blade thickness decreases while the position F of the maximum thickness gradually moves backward toward the trailing edge of the blade. As shown in FIG. 8, this shape maximizes the blade shape effect even on air flows flowing in from the outer circumference of the annular wall and allows air flowing in through the slits 6 to flow smoothly at the blade tips. Furthermore, according to this shape, the blade shape effect also serves to cause a lift acting on air flows flowing in from the blade tip or the air layer is restrained from being released at the trailing edge to enable the air flows flowing in through the slits 6 to be effectively converted into an air capacity, thereby further improving the P-Q characteristic of the fan assembly.

Furthermore, in the axial fan 21 according to this invention, the blade is shaped into a radial blade type except for its tip, so it has a large axial projected area of the blade 28 and provides as high performance as in the prior art despite the small workload of the blade 28 per area. Besides, due to its ability to reduce the blade angle of the blade 28, this invention can provide a fan assembly that can reduce the driving force required for the blades 28 while restraining stalling caused by the early release of the boundary layer on the blade suction side and that thus has a high blowing ability compared to the required driving force, in other words, has a high energy efficiency. In addition, if the axial fan 21 is driven by a motor, both the power consumption and heating of the motor can be restrained to improve the cooling efficiency of equipment incorporating this fan assembly.

If the shape of the blade tips of the axial fan of the blade type having a rearward projecting angle is optimized using the same conditions as described above, as shown in FIG. 11, and when the fan assembly is operated under a certain blowing resistance, the pressure distribution on the blade surface causes the air flows on the blade suction surface to flow in directions slightly inclined toward the inner circumference as shown by the arrows in the figure. In this case, the air flows on the blade suction surface flow over the shortest distance to reduce the flow velocity on the suction surface where the boundary layer is likely to be released, so the blade angle can be increased correspondingly without causing the boundary layer to be released, thereby increasing the blade angle from the blade tip to a boss section to allow even a blade shape near the boss to work, the blade shape being conventionally engaged in little work. Consequently, although the effect of improving the energy efficiency cannot be expected, this embodiment can provide a fan assembly of a large air capacity. Alternatively, a small fan assembly of a large air capacity can be provided that restrains the boundary layer from being released to allow the axial fan to rotate at a high speed even under operating conditions such as the fast rotation of the axial fan that are likely to cause the release of the boundary layer.

Next, another embodiment of this invention will be explained. Members similar to those shown above have the same reference numerals, and their description is omitted. Although the above first embodiment optimizes the shape of the axial fan by mainly focusing on the projection of the axial fan in the axial direction, this second embodiment focuses on sectional shapes obtained by cutting the axial fan along each chord.

Figure 12:
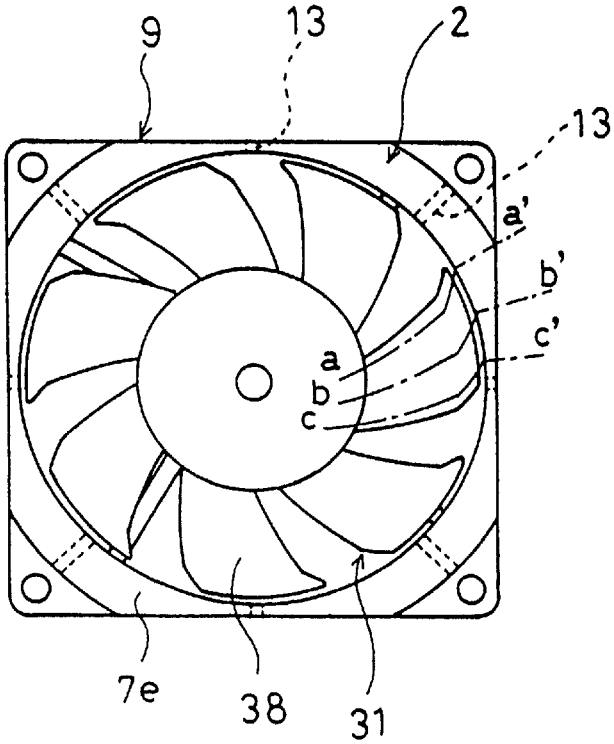
FIG. 12 is a front view of a fan assembly according to another embodiment of this invention.
Figure 13A:
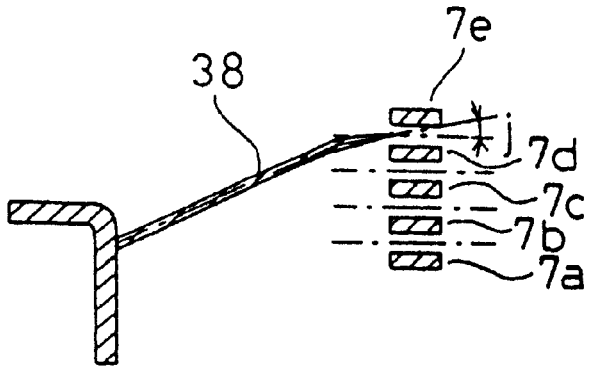
FIGS. 13*a–c* are sectional views of each blade chord of the fan assembly taken along lines a–a', b–b' and c–c' of FIG. 12, respectively.
Figure 13B:
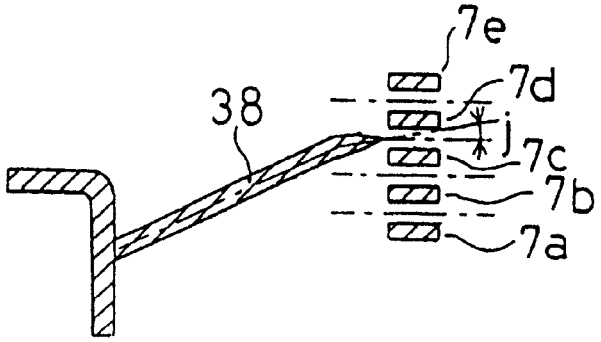
Figure 13C:
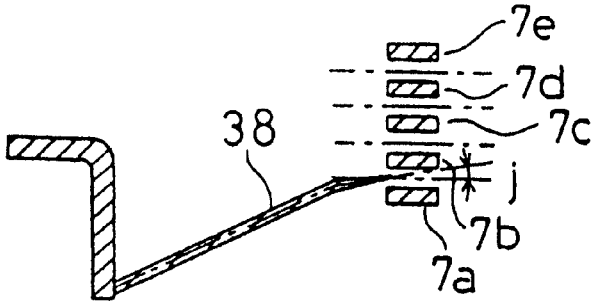
Figure 16:
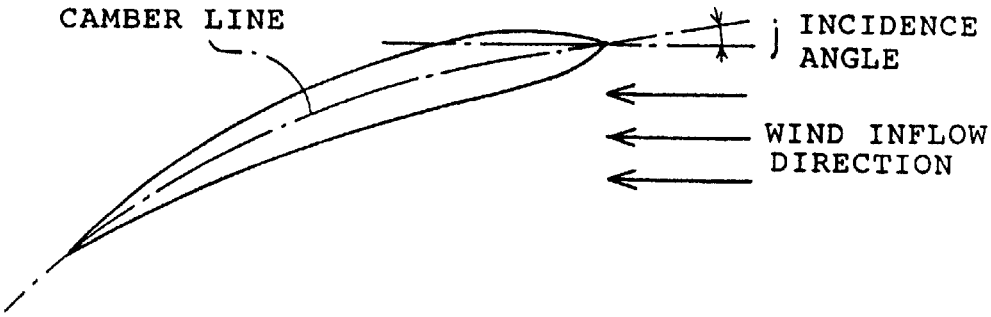
FIG. 16 is an explanatory drawing for describing a blade theory.
Figure 17:
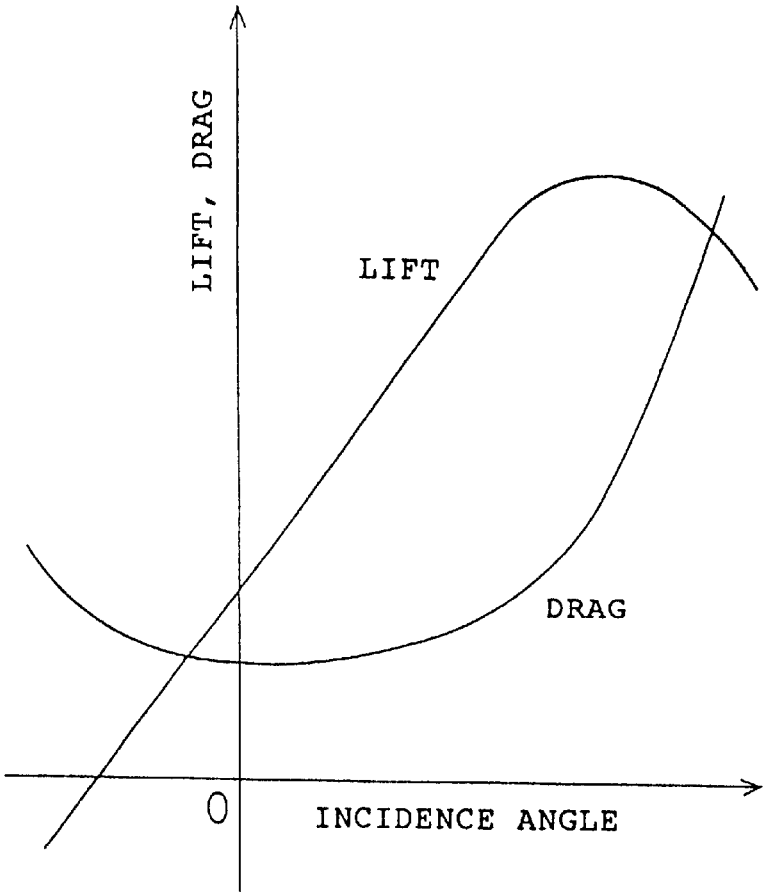
FIG. 17 is an explanatory drawing for describing the blade theory.
Figure 18:
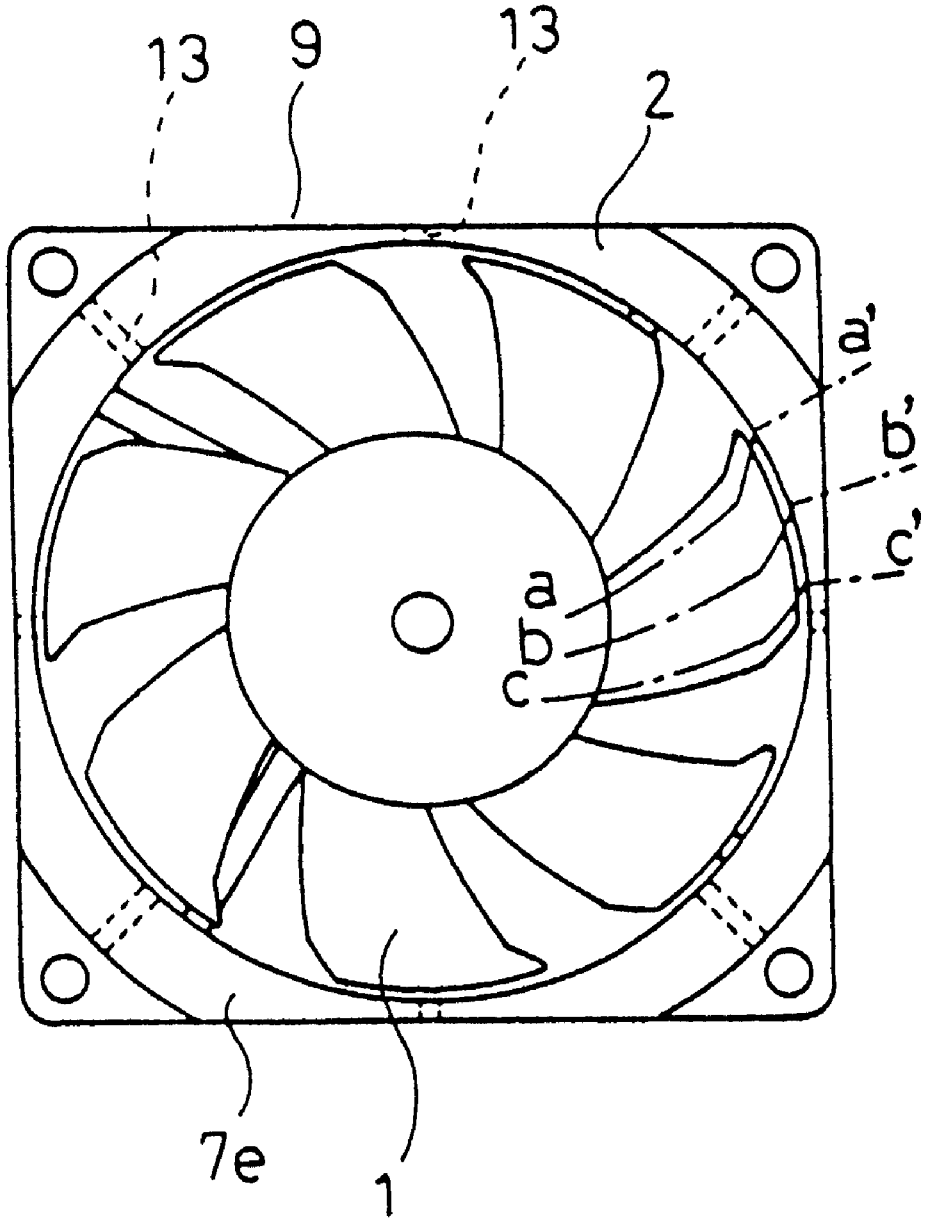
FIG. 18 PRIOR ART
FIG. 18 is a front view of a conventional fan assembly.
Figure 19A:
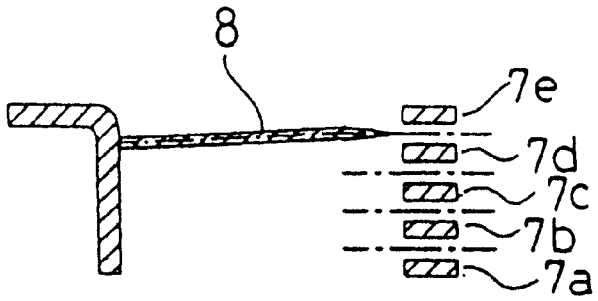
FIG. 19(a) PRIOR ART
FIGS. 19(*a*) to (*c*) are sectional views of each blade chord of the fan assembly in FIG. 18.
Figure 19B:
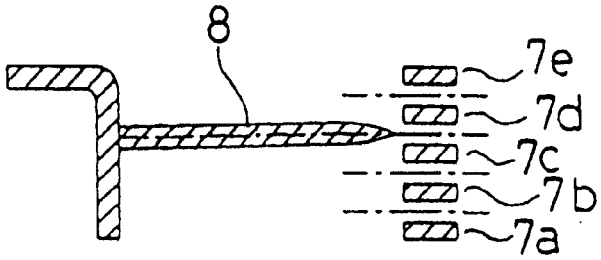
FIG. 19(b) PRIOR ART
Figure 19C:
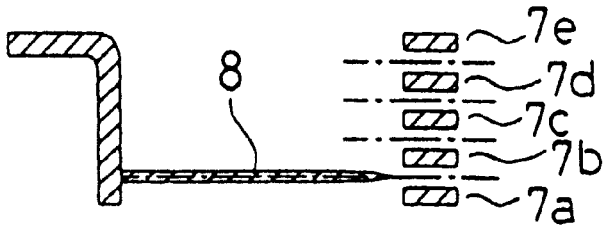
FIG. 19(c) PRIOR ART
Figure 20:
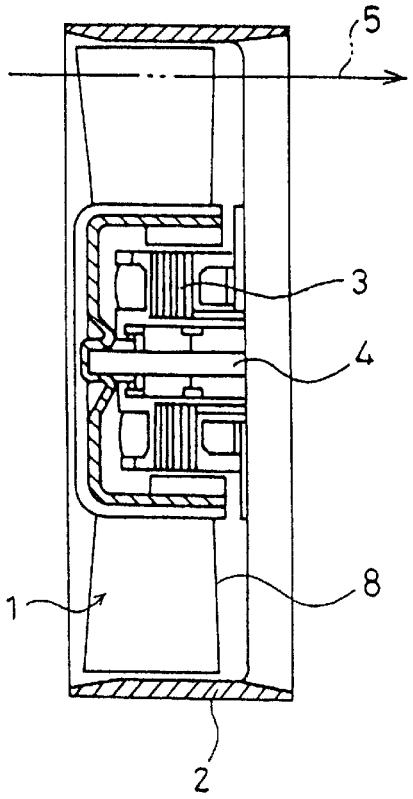
FIG.20 PRIOR ART
FIG. 20 is a sectional view showing a conventional fan assembly.
Figure 21:
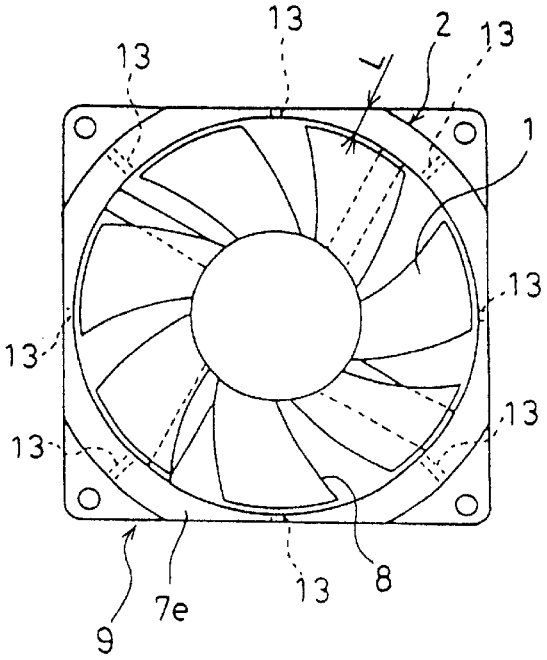
FIG.21 PRIOR ART
FIG. 21 is a front view showing a slitted fan assembly according to a prior art.
Figure 22:
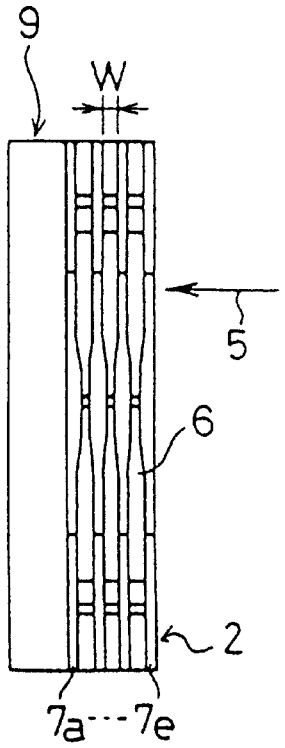
FIG. 22 is a sectional view showing the slitted fan assembly according to the prior art.
Figure 23:
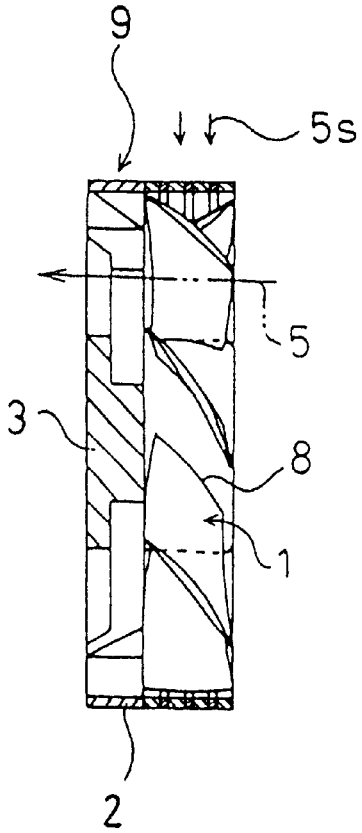
PRIOR ART FIG.23
FIG. 23 is a sectional view showing the slitted fan assembly according to the prior art.
Figure 24:
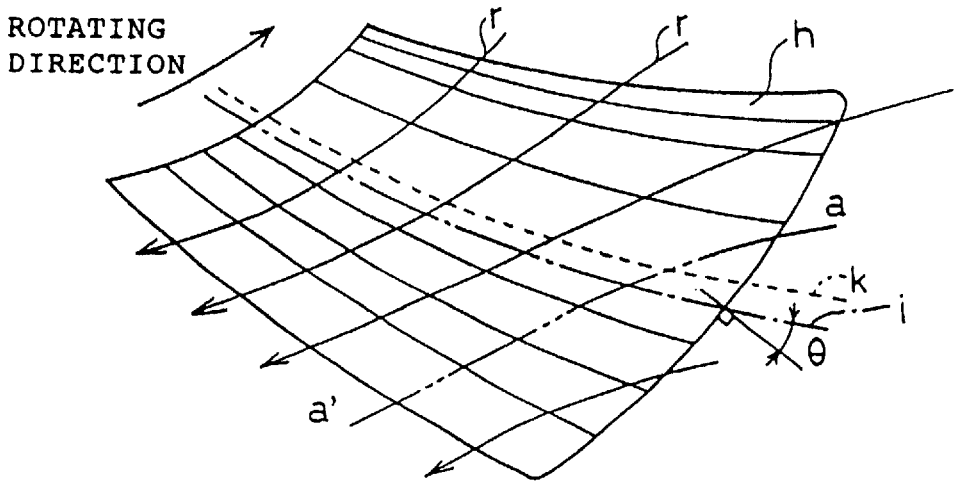
FIG.24 PRIOR ART
FIG. 24 is a blade iso-thickness diagram of a conventional axial fan.
Figure 25:
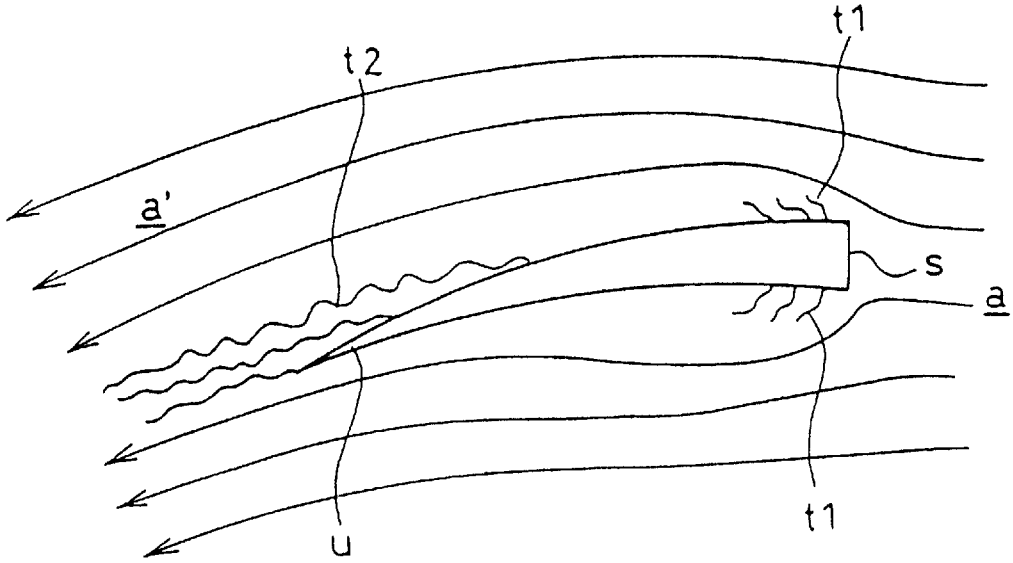
FIG.25 PRIOR ART
FIG. 25 is a sectional view of the conventional fan.
Figure 26:
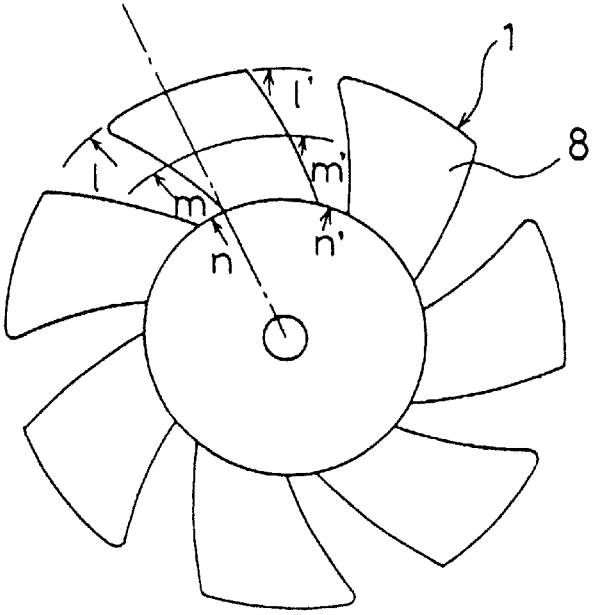
FIG.26 PRIOR ART
FIG. 26 is a front view of the conventional axial fan.
Figure 27A:
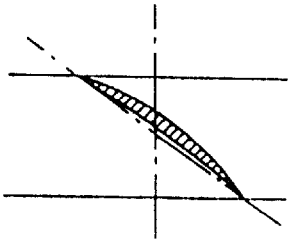
FIGS. 27(*a*) to (*c*) are sectional views showing the thickness of each portion of a blade of the conventional axial fan.
Figure 27B:
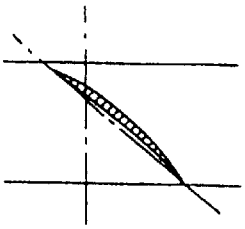
PRIOR ART FIG. 27(b)
Figure 27C:
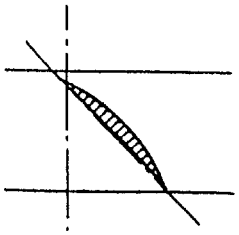
PRIOR ART FIG. 27(c)
Figure 28:
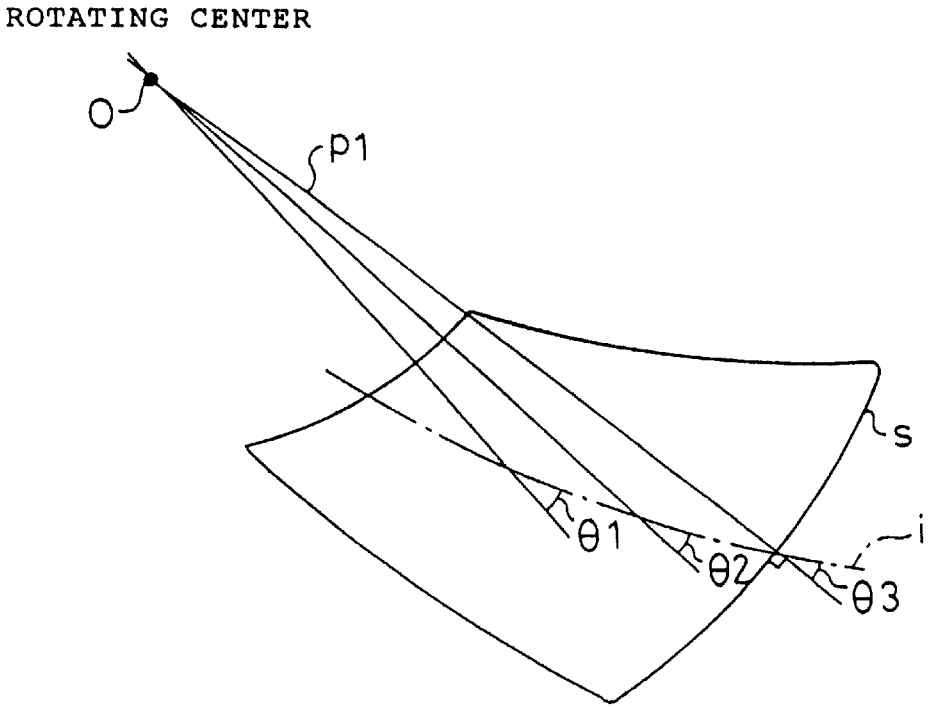
FIG.28 PRIOR ART
FIG. 28 is an explanatory drawing of a conventional blade shape.
Figure 29:
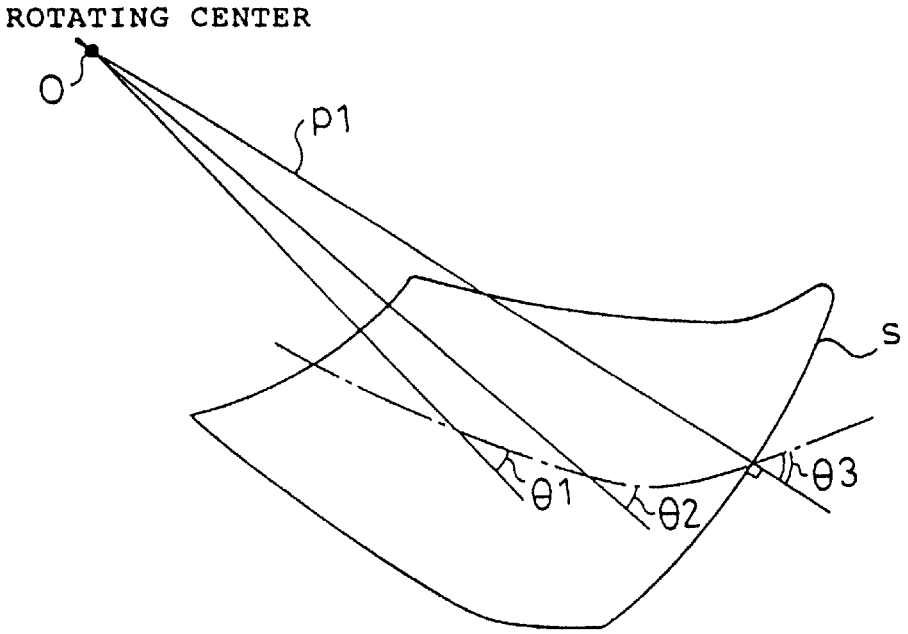
FIG.29 PRIOR ART
FIG. 29 is an explanatory drawing of a blade shape according to the prior art.
Figure 30:
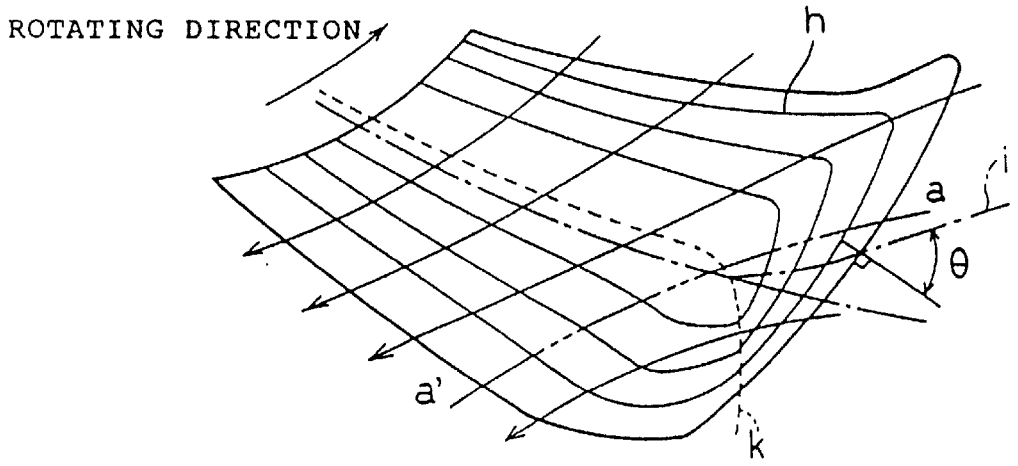
FIG.30 PRIOR ART
FIG. 30 is a blade iso-thickness diagram of an axial fan according to the prior art.
Figure 31:
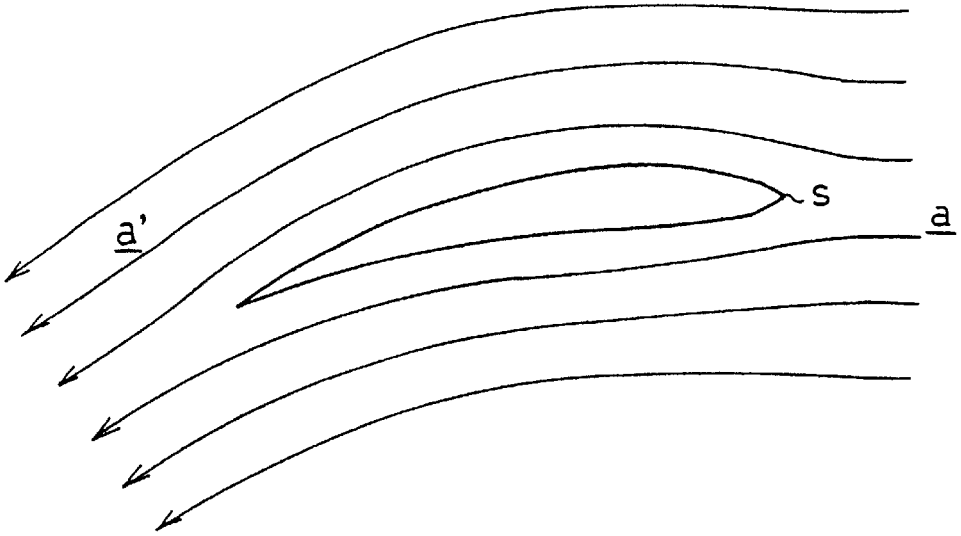
FIG.31 PRIOR ART
FIG. 31 is a sectional view of the axial fan according to the prior art.

FIGS. 18 and 19 show the fan assembly in Japanese Patent Application No. 9-260738 shown in FIGS. 29 to 33. In the sectional shape obtained by cutting the axial fan of this fan assembly along each chord, the leading edge, middle, and trailing edge of the blade all extend almost perpendicularly to the shaft, and the forward tilting angle of the blade tip is set equal to the slit angle, as shown in FIGS. 19(*a*), (*b*), and (*c*). This configuration allows components of the wind flowing along this sectional direction to be smoothly introduced, while precluding the axial fan from working for these components, FIG. 12 shows a fan assembly according to this embodiment. The sectional shapes obtained by cutting an axial fan 31 of this fan assembly along each chord differ from those in the above embodiment in that a blade 38 configures a forward tilting blade in which the blade tip direction is inclined toward the wind suction side and in that the blade tip is slightly inclined forward and toward the wind suction side relative to the angle of the slit 6, as shown in FIGS. 13(*a*), (*b*), and (*c*). The forward tilting angle of the blade tip is smaller than that of the other portions so that the blade tip is bent in the wind blowout direction. The reason for the use of the different forward tilting angle for the blade 38 will be described in light of the blade theory. FIG. 16 shows a two-dimensional blade that is cambered. In FIG. 16, angle j is referred to as an incidence angle formed by the camber line at the blade leading edge and the wind inflow direction. FIG. 17 shows the relationship between the lift and drag generated when the wind incidence angle j of this blade is varied. The blade performance is improved as the lift increases or the drag decreases, but the incidence angle that maximizes the lift acting on the blade is different from the incidence angle that minimizes the drag (air resistance) acting on the blade, as shown in FIG. 17. In general, despite the dependence on the shape of the blade, the condition for maximizing the lift is a positive incidence angle between 5 and 15°, and the condition for minimizing the drag is an incidence angle close to zero, that is, between −5 and 5°.

Figure 11:
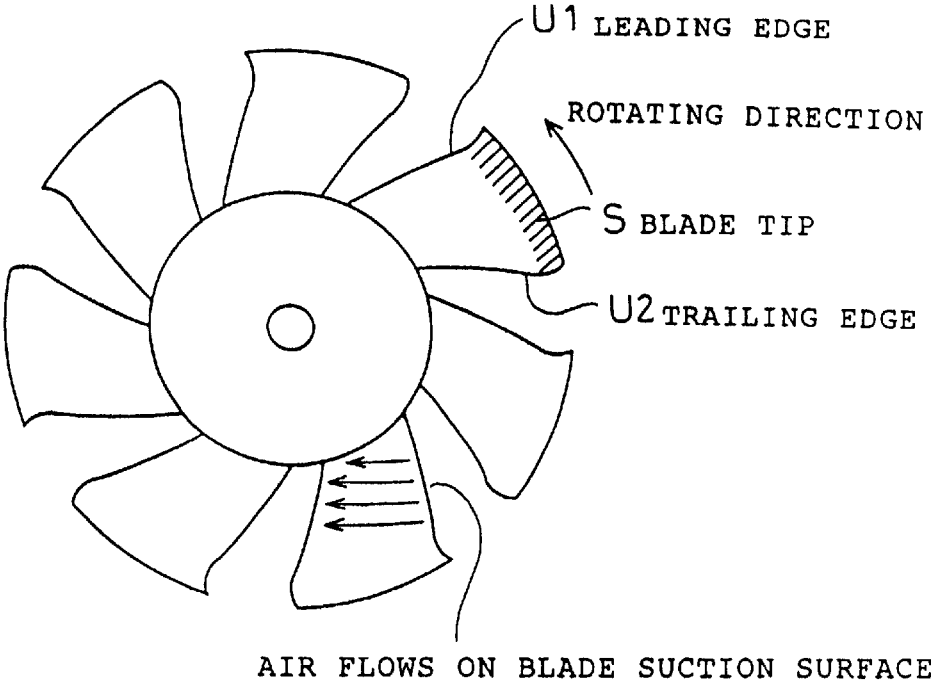
FIG. 11 is a front view of an axial fan showing another example of the embodiment.
Figure 14:
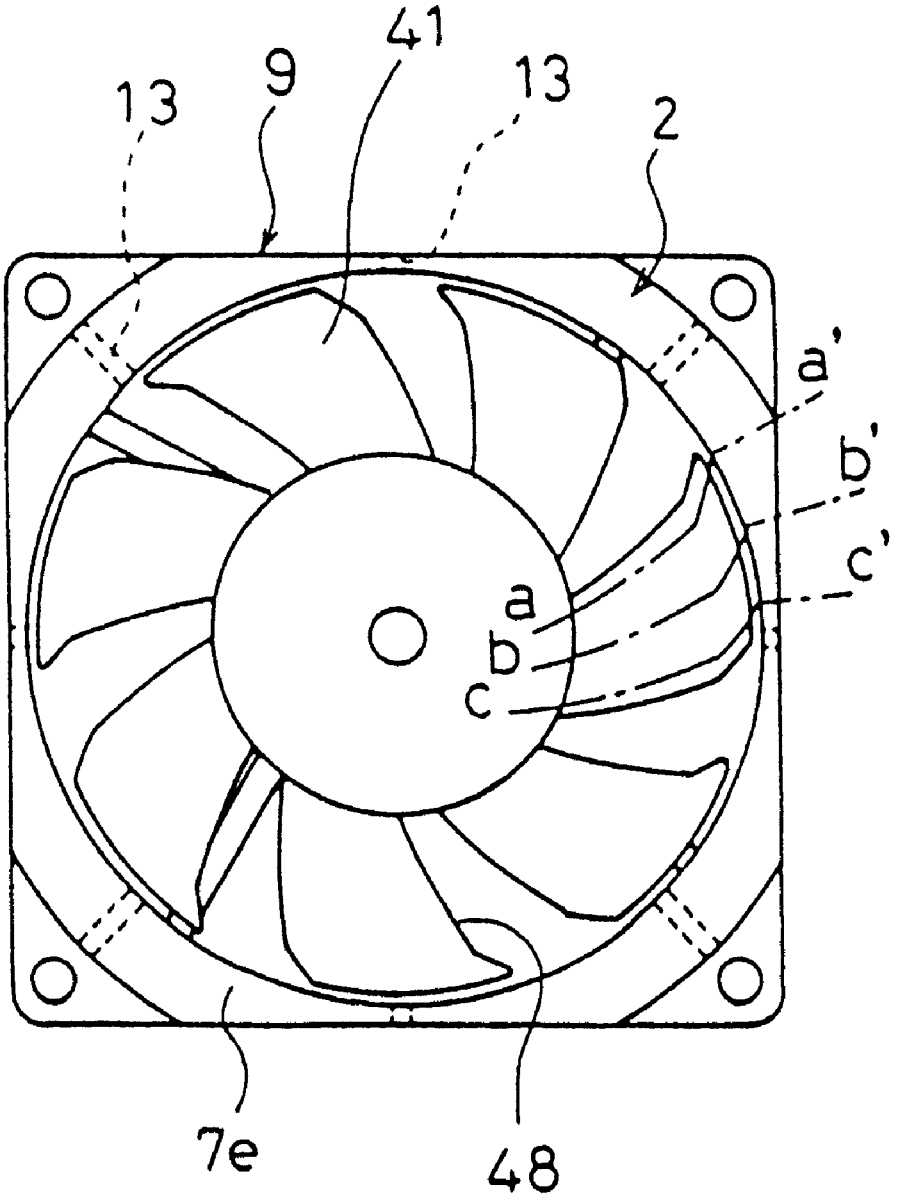
FIG. 14 is a front view of a fan assembly according to another example of the embodiment in FIG. 12.
Figure 15A:
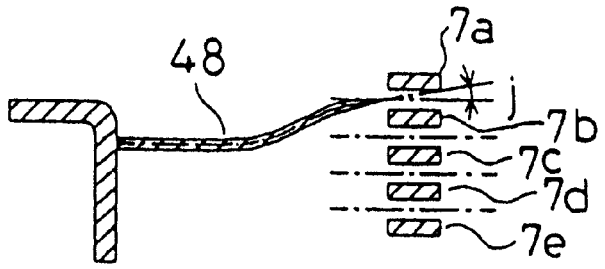
FIGS. 15(*a*) to (*c*) are sectional views obtained by cutting the fan assembly in FIG. 14 through each blade chord center line in the axial longitudinal direction.
Figure 15B:
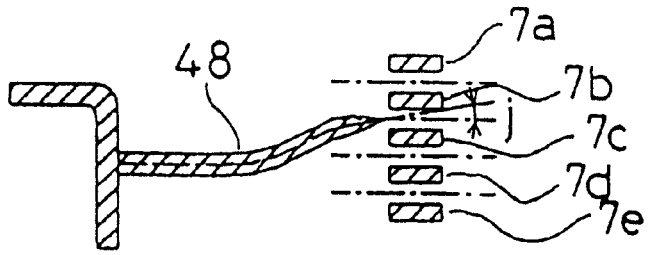
Figure 15C:
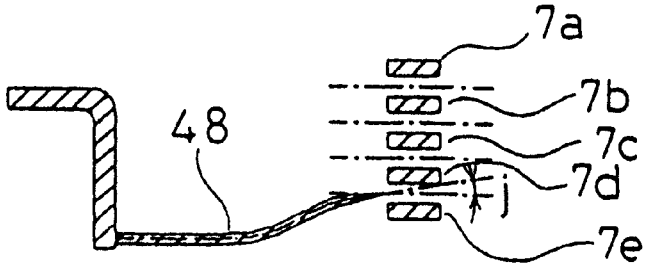

When the above blade theory is applied to the flows along the cross sections of the axial fan 31 according to this embodiment obtained by cutting the fan 31 along each chord, the incidence angle can be assumed to be the angle j (shown in FIG. 13) formed by the slit 6 angle and the forward tilting angle of the blade tip. If the blade tip has a certain incidence angle and the condition for increasing the lift is established, that is, the blade is shaped to have a forward tilting angle, those components of the wind sucked in through the slits 6 which flow in the sectional direction can be effectively converted into an air capacity to increase the existing air capacity. In addition, by setting the angle formed by the forward tilting angle and the slit 6, at a value close to zero to reduce the drag acting on the blade tip, the energy loss in this portion can be reduced to increase the energy efficiency of the entire axial fan. The blade according to this embodiment focuses on the air capacity by providing a certain angle between the forward tilting angle of the blade tip and the slit 6. In general, in order to provide such a characteristic, the angle between the forward tilting angle of the blade tip and the slit 6 must be between −5 and 15° and the tip must be bent in the wind blowout direction With too large an angle between the forward tilting angle of the blade tip and the slit 6 angle, the boundary layer may be released on the suction side of the blade 38 to reduce the efficiency and the air capacity. With too small an angle, the lift generation is prevented to reduce the air capacity, thereby releasing the boundary layer on the positive pressure side of the blade 38 to reduce the efficiency. In addition, if the tip of the blade 38 is bent in the wind suction direction, the blade tip has the opposite camber direction to cause a lift acting in the opposite direction, thereby reducing the air capacity. In addition, although in this embodiment, the forward tilting angle of the blade is almost constant except for the blade tip, this configuration increases the axial length of the axial fan 31 and thus the size of the fan assembly in the direction of the fan shaft. Thus, the neighborhood of the tip of a blade 48 of the axial fan 41 is bent in the wind blowout direction whereas the root of the blade is bent in the wind suction direction so that the cross section of the blade 48 is S-shaped, as shown in FIGS. 14 and 15. Then, air flows flowing in from the blade 48 tip flow out from the blade trailing edge before reaching the blade root, as shown in FIG. 11, so the air flows near the blade root move almost along the circumference. Accordingly, a fan assembly that provides the maximum P-Q characteristic can be provided by bending the blade tip in the wind blowout direction, while bending in the wind suction direction the neighborhood of the blade 48 root, which is not significantly affected by radial flows, to reduce the length of the axial fan 41 in the direction of the fan shaft and thus the size of the fan assembly, in particular, the axial size.

Although this embodiment has shown the blade type having a forward tilting angle as the shape of the axial fan, similar effects can be obtained by applying this embodiment to the axial fan of the radial or the blade type having a rearward projecting angle shown in the above embodiments. Due to their synergetic effect, this combination can improve the energy efficiency or further improve the P-Q characteristic. If the above fan assembly is provided in electronic equipment, for example, a personal computer, noise from the electronic equipment can be reduced and the cooling and energy efficiency can be improved.

As described above, this invention forms the plurality of slits making the inner and outer circumferential portions of the annular wall in communication with each other and bends the tips of the blades of the fan in the rotating direction. This configuration enables air flows flowing in through the slits to be smoothly taken, thereby improving the P-Q characteristic of the fan assembly and reducing noise from the fan assembly. Furthermore, it can improve the energy efficiency of the fan assembly.

What is claimed is:

1. A fan assembly comprising an annular wall (2) formed with a space left from blade tips of a fan, and a plurality of slits (6) formed in a portion of the annular wall (2) opposite to said blade tips of the fan, said slits communicating the inner and outer circumferential portions of the annular wall (2) with each other, wherein said fan is formed to have a radial blade shape with a zero sweepforward angle, in which the tip of a blade (28) is bent in the rotating direction while the other portion of the blade than the tip thereof is not inclined in the rotating direction.

2. The fan assembly according to claim 1 wherein the fan is configured so that a cross section obtained by cutting it in a concentric cylindrical surface of a rotating shaft is in a blade shape and in each cross section, a position of the maximum thickness of the blade moves backward toward a blade trailing edge according as the position approaches the blade tip.

3. The fan assembly according to claim 1 wherein the fan is configured so that the sweepforward angle θ at the blade tip, the average flow velocity v of air flowing in from the outer circumferential direction of the annular wall, and the peripheral speed u at the blade tip satisfy the following equation:

$$\theta=\tan^{-1}(u/v).$$

4. A fan assembly comprising an annular wall (2) formed with a space left from blade tips of a fan, and a plurality of slits (6) formed in a portion of the annular wall (2) opposite to said blade tips of the fan, said slits communicating the inner and outer circumferential portions of the annular wall (2) with each other, wherein said fan is formed to have a rearward projecting blade shape, in which the tip of a blade (28) is bent in the rotating direction and the other portion of the blade than the tip thereof is inclined in the direction opposite to the rotating direction.

5. A fan assembly comprising an annular wall (2) formed with a space left from blade tips of a fan, and a plurality of slits (6) formed in a portion of the annular wall (2) opposite to said blade tips of the fan, said slits communicating the inner and outer circumferential portions of the annular wall (2) with each other, wherein said fan is configured so that the tips of the blades (28, 38, 48) are bent in the rotating direction, the sweepforward angle of the blade tips relative to the radial direction is −5 to 15°, and the blade tips and the vicinity thereof are bent in the wind blowout direction.

6. The fan assembly according to claim 5 wherein the fan is configured so that the cross section of the blade obtained by cutting it along the center line of each blade chord in the axial longitudinal direction is curved in an S-shape.

7. The fan assembly according to claim 5 wherein the fan is formed so that the blades except the tips thereof are in a shape of a radial or a rearward tilting blade.

8. A fan assembly comprising an annular wall (2) spaced from tips of blades of a fan, and a plurality of slits (6) formed in a portion of the annular wall (2) opposite said blade tips, said slits communicating the inner and outer circumferential portions of the annular wall (2) with each other, wherein said fan blades extending radially with a zero sweepforward angle, in which the tip of a blade (28) is bent in the rotating direction while the portion of the blade other than the tip thereof is not inclined in the rotating direction, and wherein the thickness of the blade near the blade tip decreases toward the blade tip.

9. Electronic equipment including a fan assembly comprising an annular wall (2) spaced from tips of blades of a fan, and a plurality of slits (6) formed in a portion of the annular wall (2) opposite to said blade tips, said slits communicating the inner and outer circumferential portions of the annular wall (2) with each other, wherein said fan blades extend radially with a zero sweepforward angle, in which the tip of a blade (28) is bent in the rotating direction while the portion of the blade other than the tip thereof is not inclined in the rotating direction.

* * * * *